United States Patent [19]

McKay

[11] 4,422,201

[45] Dec. 27, 1983

[54] LINT REMOVER

[75] Inventor: Nicholas D. McKay, Grand Blanc, Mich.

[73] Assignee: Helmac Products Corporation, Flint, Mich.

[21] Appl. No.: 290,785

[22] Filed: Aug. 6, 1981

[51] Int. Cl.[3] ..... A47L 25/00

[52] U.S. Cl. ..... 15/104 A; 15/230.11; 242/55.2

[58] Field of Search ..... 15/27, 104 A, 230.11; 242/55.2

[56] References Cited

U.S. PATENT DOCUMENTS

| | | | |
|---|---|---|---|
| 1,851,722 | 3/1932 | Moore | 242/55.2 |
| 2,401,842 | 6/1946 | Slater | 15/104 |
| 2,758,327 | 8/1956 | Kennon | 15/104 A |
| 3,201,815 | 8/1965 | Selby | 15/104 A |
| 3,225,373 | 12/1965 | Kisbany | 15/104 A |
| 3,421,170 | 1/1969 | Thomas, Jr. | 15/104 |
| 3,623,179 | 11/1971 | Roth | 15/104 A |

FOREIGN PATENT DOCUMENTS

| | | | |
|---|---|---|---|
| 470872 | 5/1969 | Switzerland | 15/104 A |

*Primary Examiner*—Chris K. Moore

*Attorney, Agent, or Firm*—Miller, Morriss & Pappas

[57] ABSTRACT

A lint remover assembly comprising a unitary integrally formed adhesive tape roll sleeve-engaging hollow support cylinder having an open outer end and provided with an elongate integral handle portion extending axially outwardly from one end thereof. An adhesive tape roll sleeve assembly provided for selective axial slidable covering engagement with the hollow support cylinder so as to be selectively rotatable thereon upon movable contact across a surface being cleaned. A closure plug provided to make frictional closure engagement with the open outer end of the hollow support cylinder so as to cooperate therewith to define a storage compartment therein.

9 Claims, 23 Drawing Figures

LINT REMOVER

This invention relates to a unitary formed lint remover comprising an adhesive tape roll sleeve-engaging hollow support cylinder having an integral handle portion extending axially outwardly from one end thereof. An adhesive tape roll sleeve assembly is provided for selective axial slidable covering engagement with the support cylinder so as to be selectively rotatable thereon upon movable contact across a surface being cleaned. An adhesive tape roll sleeve-engaging annular stop flange is provided at the end of the hollow cylinder proximate to the handle portion. A plurality of resiliently mounted radially extending adhesive tape roll sleeve-engaging flange elements are provided along the open outer end of the hollow support cylinder in spaced-apart axially aligned register with an annular stop flange so as to selectively retain the adhesive tape roll sleeve assembly therebetween while permitting rotative movement thereof on the support cylinder.

The outer surface of the hollow support cylinder is selectively provided with at least two spaced-apart annular bearing ridges thereon which are adapted to slidably engage the inner surface of the adhesive tape roll sleeve assembly mounted on the hollow support cylinder so as to facilitate relative selective rotative movement of the sleeve assembly with respect thereto.

In another embodiment of the invention a closure plug is provided so as to make frictional engagement with the open outer end of the hollow cylinder portion of the lint remover so as to cooperate therewith to define a storage compartment therein. The closure plug is selectively provided with an adhesive tape roll sleeve-engaging annular closure plug stop flange thereby eliminating the need for the resiliently mounted radially extending flange elements provided on the open outer end of the hollow support cylinder.

In use, the adhesive tape roll sleeve assembly is axially slidably positioned in covering engagement on the hollow support cylinder so that one end thereof is in abutting slidable engagement with the hollow support cylinder stop flange. Thus positioned, the opposite end of the adhesive tape roll sleeve is selectively restrained against relative axial movement on the hollow support cylinder by the radially extending flange elements provided on the outer end of the hollow support cylinder while the adhesive tape roll sleeve assembly is selectively rotatable on the hollow cylinder. The lint remover is utilized by holding it so that the outer adhesive surface of the adhesive tape roll sleeve assembly bears against the surface to be cleaned. The lint remover is selectively moved so as to cause the adhesive tape roll sleeve assembly to rotate upon the hollow cylinder so as to roll the surface being cleaned so that the adhesive tape engages and removes lint, dirt and other impurities from the surface being cleaned. When the supply of adhesive tape on the adhesive tape roll sleeve assembly is exhausted, the adhesive tape roll sleeve assembly can be axially slidably removed from the hollow support cylinder for replacement by a new adhesive tape roll sleeve assembly.

None of the prior art lint remover devices provide an integrally molded unitary handle and hollow support cylinder which is adapted to selectively rotatably support an adhesive tape roll sleeve assembly thereon which can be easily removed for replacement when the supply of adhesive tape is exhausted. Further, none of the known prior art lint remover devices are provided with a convenient storage compartment therein.

A need has therefore existed for a unitary integrally molded lint remover wherein an adhesive tape roll sleeve assembly hollow support cylinder is provided having an integral fixed handle which axially extends from one end thereof.

A further need has existed for a unitary integrally molded lint remover which is adapted to selectively rotatably support an adhesive tape roll sleeve assembly thereon while selectively restraining it from axial movement with respect thereto. A still further need has existed for a unitary integrally molded lint remover defining a storage compartment therein.

It is therefore an object of this invention to provide a unitary integrally molded adhesive tape roll sleeve assembly hollow support cylinder having a fixed elongate handle extending axially from one end thereof.

Another object of this invention is to provide a unitary integrally molded lint remover which is adapted to selectively rotatably support an adhesive tape roll sleeve assembly thereon while selectively restraining it from axial movement with respect thereto.

Yet another object of this invention is to provide a unitary integrally molded lint remover defining a storage compartment therein.

Other objects and advantages found in the construction of the invention will be apparent from a consideration of the following specification in connection with the appended claims and the accompanying drawings.

IN THE DRAWINGS

DESCRIPTION

Figures 1, 2, 3, 4, 5, 6:
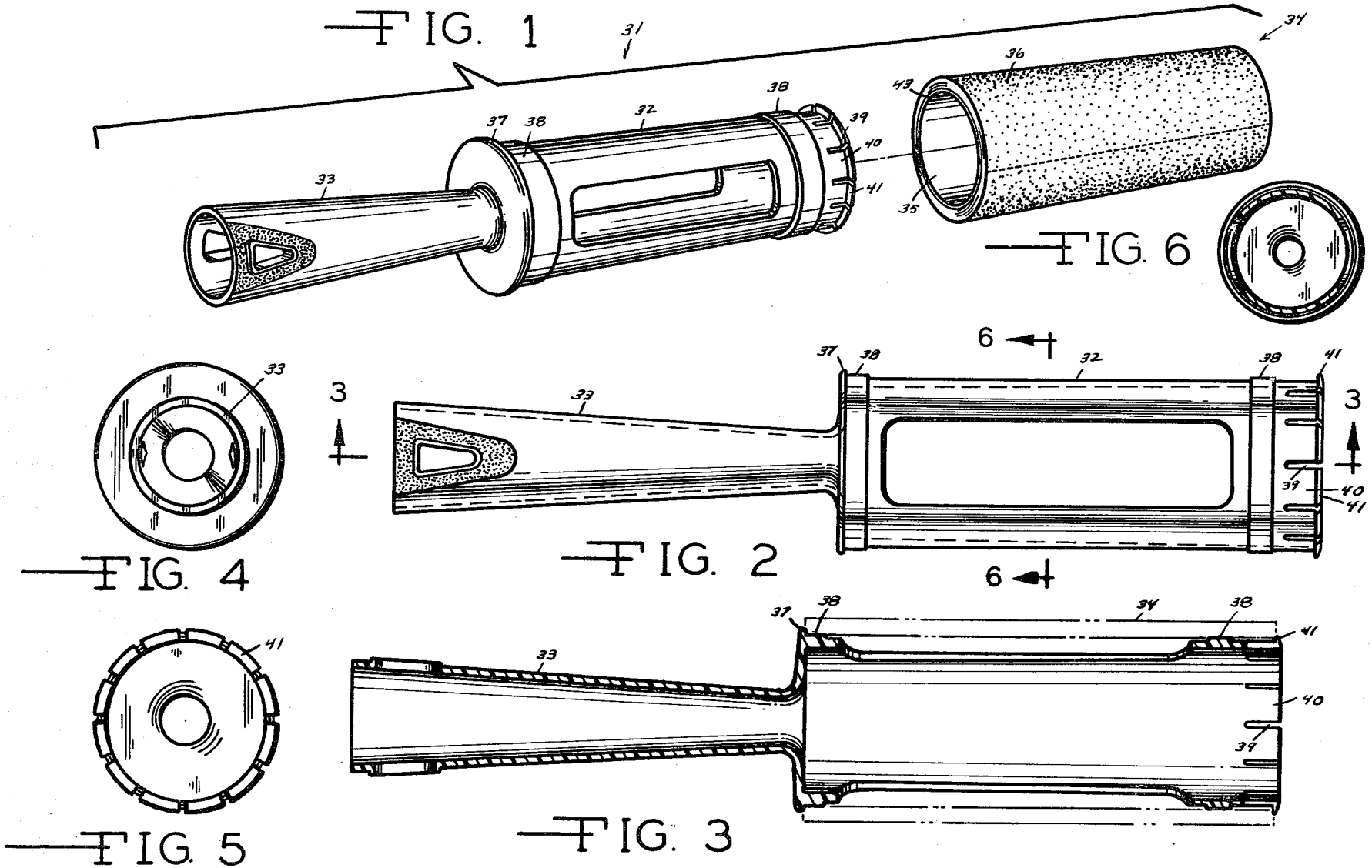
FIG. 1 is an exploded schematic perspective view of the lint remover showing the adhesive tape roll sleeve assembly which is selectively positioned thereon.
FIG. 2 is a side elevational view of the integrally formed lint remover showing the adhesive tape roll sleeve assembly hollow support cylinder and the integral handle portion extending axially from one end thereof.
FIG. 3 is a schematic cross-sectional view thereof taken on line 3—3 of FIG. 2 with the adhesive tape roll sleeve assembly shown in phantom-line.
FIG. 4 is a left end view of the lint remover as shown in FIG. 2.
FIG. 5 is a right end view of the lint remover as shown in FIG. 2.
FIG. 6 is a schematic cross-sectional view thereof taken on line 6—6 of FIG. 2.
Figure 7:
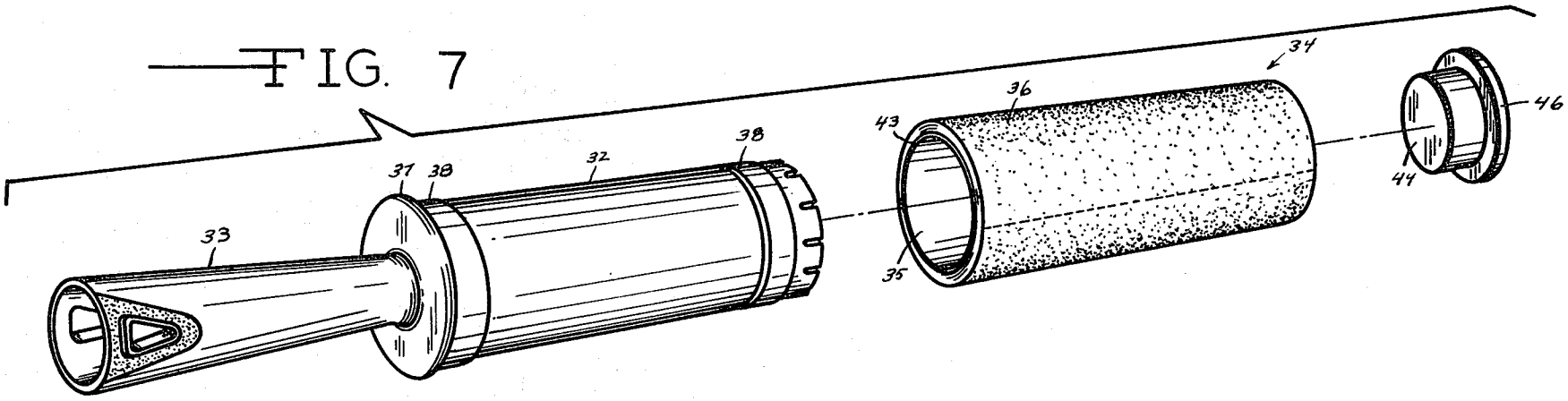
FIG. 7 is an exploded schematic perspective view of a modified form of the lint remover which includes a closure plug for the hollow support cylinder.
Figure 8:
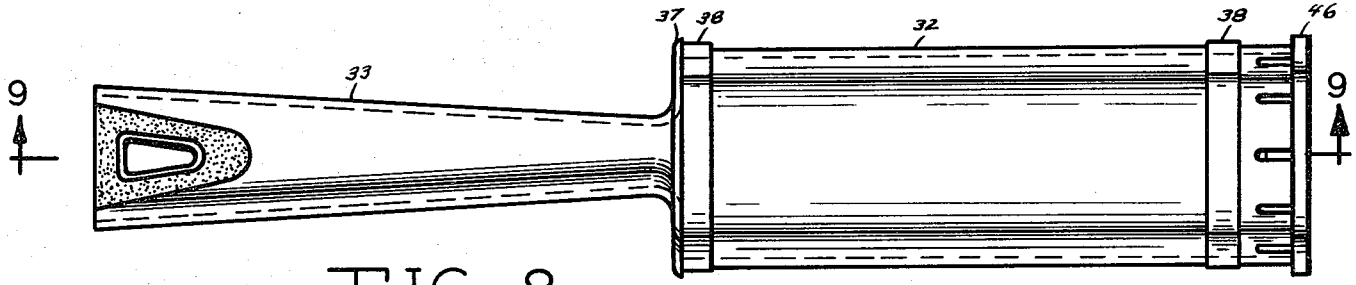
FIG. 8 is a side elevational view of the modified lint remover shown in FIG. 7 without the adhesive tape roll sleeve assembly thereon.

As shown in FIG. 1, the lint remover 31 comprises a unitary integrally molded adhesive tape roll sleeve assembly-engaging hollow support cylinder 32 having an integral fixed elongate handle 33 extending axially from one end thereof. The hollow support cylinder 32 and its integrally formed handle 33 is molded from plastic. While the handle 33 has a hollow conical configuration, it is considered to be within the scope of the invention that the handle have any desired configuration. An adhesive tape roll sleeve assembly 34 is provided which includes a tubular sleeve 35 upon which a roll of lint remover adhesive tape 36 having an outwardly facing adhesive surface is provided. The sleeve 35 can be fabricated from plastic, cardboard or any other desired material. An adhesive tape roll sleeve-engaging annular stop flange 37 is provided on the hollow support cylinder 32 proximate the handle end thereof. At least two spaced-apart annular bearing ridges 38 are provided on the outer surface of the hollow support cylinder 32 which are adapted to slidably engage the inner surface of the adhesive tape roll sleeve 35 mounted on the support cylinder 32 so as to facilitate rotative movement of the sleeve assembly 34 on the hollow support cylinder 32. It is considered to be within the scope of the invention that the outer surface of the hollow support cylinder 32 directly slidably matingly engages the inner surface of the sleeve 35 so as to permit selective rotatable movement of the sleeve assembly 34 thereon. The outer circumferential edge of the hollow support cylinder 32 is provided with spaced-apart longitudinally oriented slots 39 which divide the circumferential edge into a plurality of resilient fingers 40 that are provided with radially extending transverse flange elements 41 that are configured to retainably engage the end portion 42 of the sleeve 35 mounted on the hollow support cylinder 32.

In use, the resilient fingers 40 are biased radially inwardly as the adhesive tape roll sleeve assembly 34 is slidably longitudinally passed thereover into its operative use position on the hollow support cylinder 32. When the adhesive tape roll sleeve assembly 34 is in its operative use position on the hollow support cylinder 32, the end portion 43 of the sleeve 35 slidably abuts the annular stop flange 37. With the sleeve assembly 34 thus positioned, the opposite end 42 of the sleeve 35 is retainably slidably engaged by the flange elements 41 which have sprung back into their normal use position after the adhesive tape roll sleeve assembly 34 has moved into its operative use position on the hollow support cylinder 32 as shown in phantom-line in FIG. 3. Thus positioned, the adhesive tape roll sleeve assembly 34 is selectively rotatable on the support cylinder 32 so as to perform its lint removing function.

During manufacture, the adhesive tape 36 is rolled onto the sleeve 35 with the adhesive surface facing outwardly and consists of perforated sections that can be selectively detached as the adhesive surface is filled with lint. In a manner well known in the prior art, the adhesive surface is rollably moved over the surface being cleaned and the lint particles, dirt and other impurities adhere thereto. When the outer adhesive tape surface becomes full of lint, the used section thereof is torn off so as to expose a new adhesive tape surface therebelow. This is repeated until the tape is completely used. The used adhesive tape roll assembly 34 is then axially slidably removed from the support cylinder 32 and a new replacement adhesive tape roll sleeve assembly 34 is placed thereon.

Figure 9:
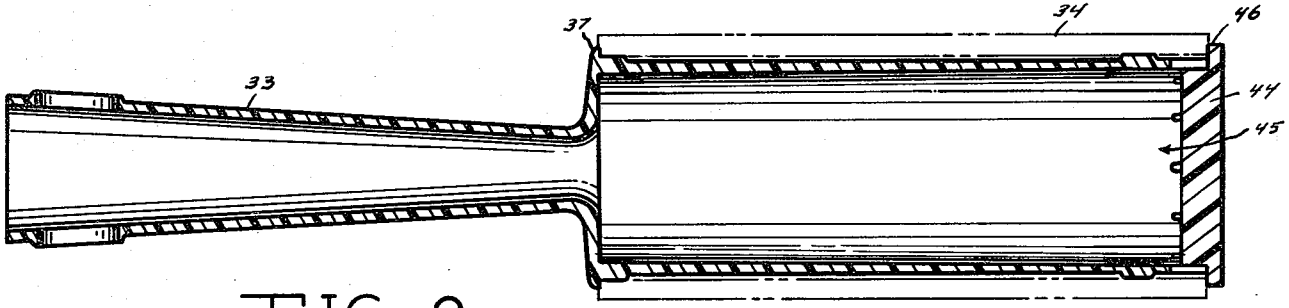
FIG. 9 is a schematic cross-sectional view of the modified lint remover taken on line 9—9 of FIG. 8 and showing the adhesive tape roll sleeve assembly in phantom-line thereon.
Figure 10:
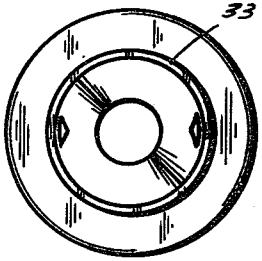
FIG. 10 is a left end view of the modified lint remover shown in FIG. 8.
Figure 11:
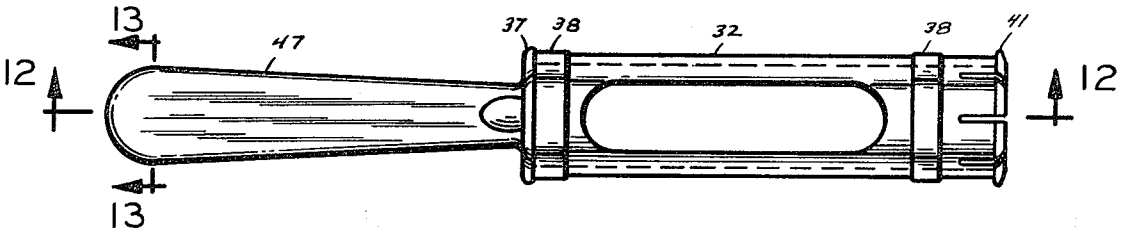
FIG. 11 is a side-elevational view of a modified lint remover showing an integral flat handle portion extending axially from one end of the hollow support cylinder.
Figure 12:
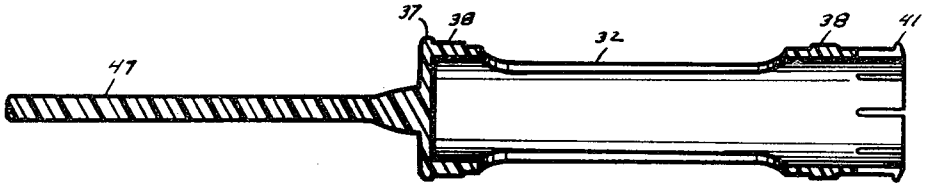
FIG. 12 is a cross-sectional view thereof taken on line 12—12 of FIG. 11.
Figure 15:
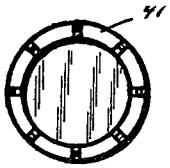
FIG. 15 is a right end view of the modified lint remover shown in FIG. 11.
Figure 14:
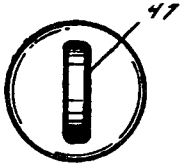
FIG. 14 is a left end view of the modified lint remover shown in FIG. 11.
Figure 13:
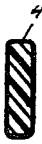
FIG. 13 is a cross-sectional view thereof taken on line 13—13 of FIG. 11.
Figure 16:
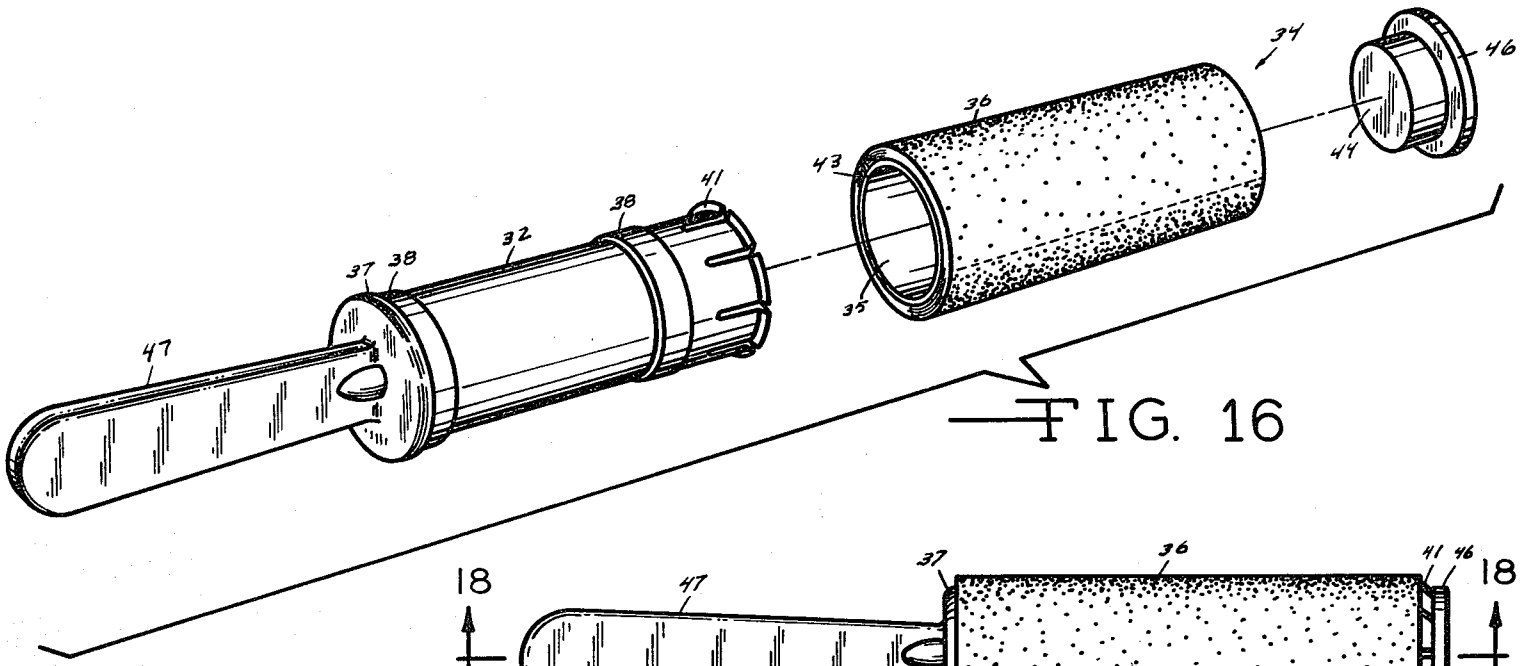
FIG. 16 is an exploded schematic perspective view of the modified lint remover showing a closure plug in association therewith.
Figure 17:
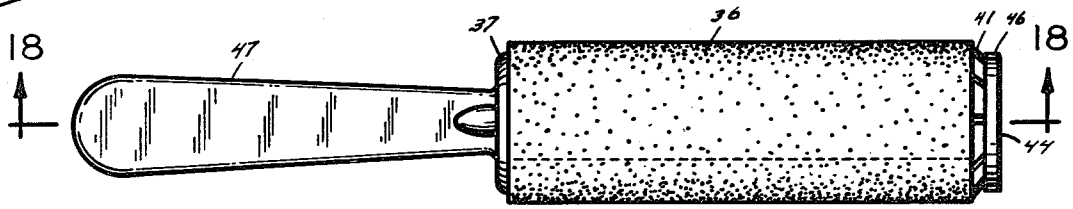
FIG. 17 is a side elevational view of the assembled modified lint remover shown in FIG. 16.
Figure 19:
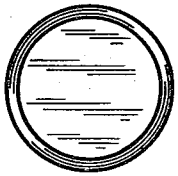
FIG. 19 is a right end view of the modified lint remover shown in FIG. 17.
Figure 18:
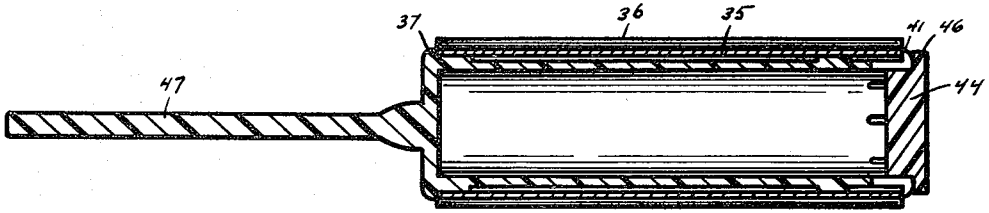
FIG. 18 is a schematic cross-sectional view of the modified lint remover taken on line 18—18 of FIG. 17.
Figure 20:
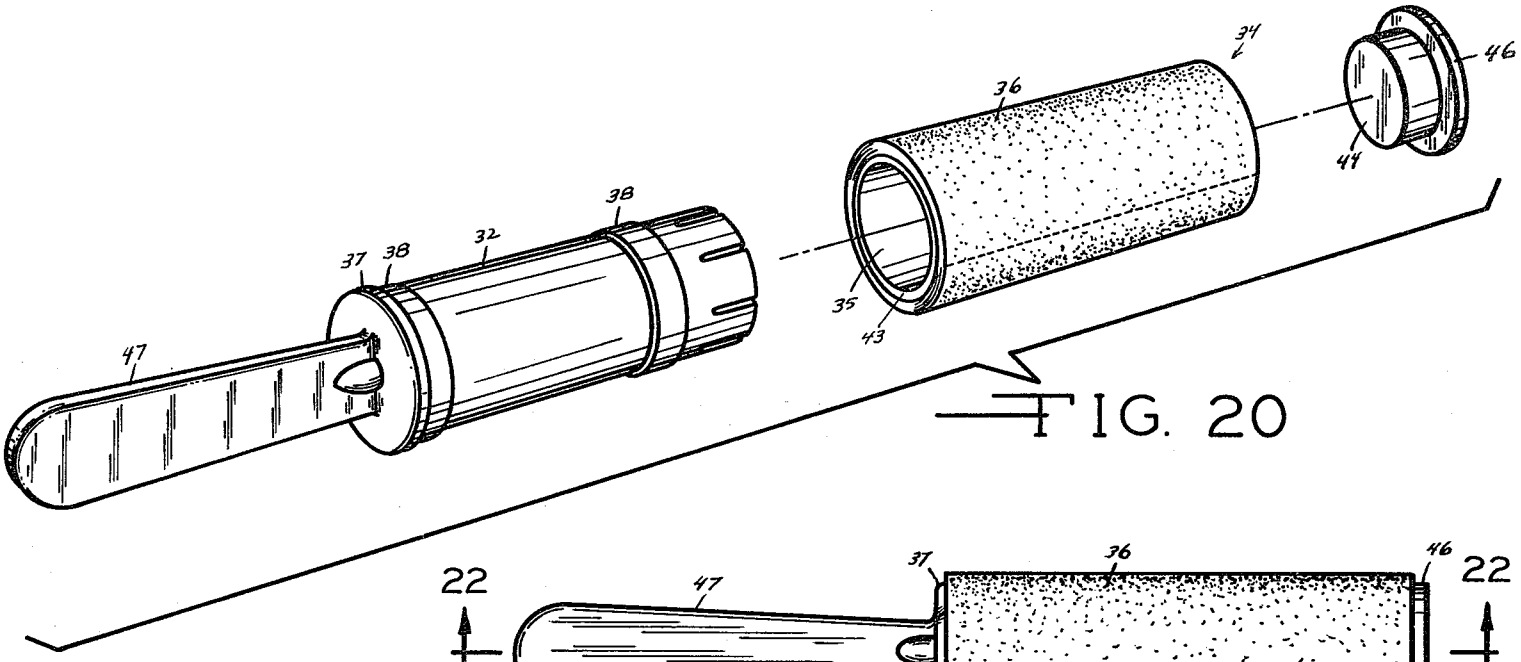
FIG. 20 is an exploded schematic perspective view of another modified lint remover.
Figure 21:
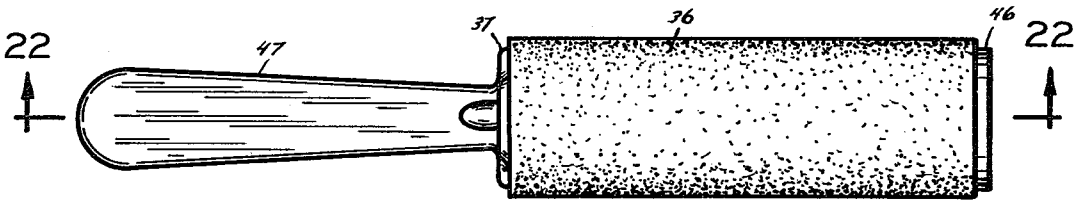
FIG. 21 is a side elevational view of the assembled modified lint remover shown in FIG. 20.
Figure 23:
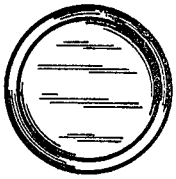
FIG. 23 is a right end view of the modified lint remover shown in FIG. 21.
Figure 22:
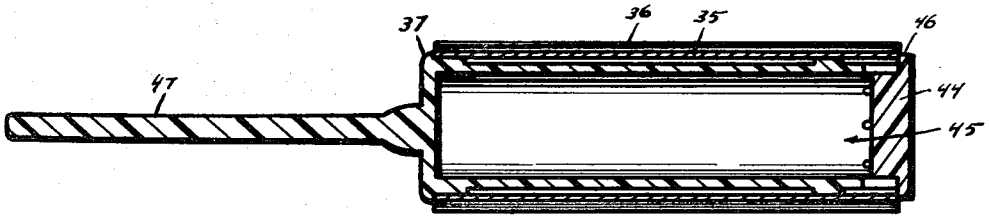
FIG. 22 is a schematic cross-sectional view of the modified lint remover taken on line 22—22 of FIG. 21.

As shown in FIGS. 7 through 10, another embodiment of the invention is provided with a closure plug 44 which is adapted to be frictionally insertable into the open outer end of support cylinder 32 so as to effect closure thereof to form a storage compartment 45. The closure plug 44 is provided with an adhesive tape roll sleeve-engaging annular stop flange 46. As shown in FIG. 9, the annular stop flange 46 performs the same adhesive tape roll sleeve retaining function as the flange elements 41 of the embodiment of the invention shown in FIGS. 1 through 5. It is within the scope of this invention that the closure plug 44 can be utilized in conjunction with the flange elements 41 as shown in the embodiment of the invention shown in FIGS. 16 through 19.

As shown in the FIGS. 11 through 23, two embodiments of the invention utilize an elongate flat handle 47 instead of the conical handle 33 utilized in the embodiment of the invention shown in FIGS. 1 through 10. As shown, the flat handle 47 is also integrally molded to the end of the support cylinder 32 and extends axially outwardly therefrom.

In summary, a lint remover assembly is provided which comprises a unitary integrally formed adhesive tape roll sleeve-engaging hollow support cylinder having an open outer end. The hollow support cylinder has an integral elongate handle portion extending axially outwardly from one end thereof. An adhesive tape roll sleeve assembly is provided for selective axially slidable covering engagement with the hollow support cylinder. The adhesive tape roll sleeve assembly is selectively rotatable on the hollow support cylinder. The adhesive tape roll sleeve assembly includes a hollow sleeve member. The hollow sleeve member is provided with a lint removing adhesive tape roll positioned thereon. An adhesive tape roll sleeve-engaging annular stop flange is provided at the handle end of the hollow support cylinder and a plurality of resiliently mounted radially extending adhesive tape roll sleeve-engaging flange elements are provided on the peripheral edge of the open outer end of the hollow support cylinder in axially aligned spaced-apart register with the annular stop flange. The annular stop flange and the flange elements are adapted to selectively slidably retain the sleeve member therebetween so as to restrain the adhesive tape roll sleeve assembly against relative axial movement on the hollow support cylinder while permitting selective rotative movement of the adhesive tape roll sleeve assembly on the hollow support cylinder. A closure plug is provided for selective frictional closure engagement with the open outer end of the hollow support cylinder. The closure plug is provided with an adhesive tape roll sleeve-engaging annular stop flange. The closure plug cooperates with the hollow support cylinder so as to define a storage compartment therein.

In summary, a highly utilitarian lint remover is provided which comprises a unitary integrally formed hollow support cylinder and handle member assembly adapted to rotatably support an adhesive tape roll sleeve assembly thereon. A closure plug is selectively provided for frictional closure engagement with the hollow support cylinder so as to define a storage compartment therein.

Various other modifications of the invention may be made without departing from the principle thereof. Each of the modifications is to be considered as included in the hereinafter appended claims, unless these claims by their language expressly provide otherwise.

I claim:

1. In a lint remover assembly, the combination comprising:

a unitary integrally formed adhesive tape roll sleeve-engaging cylindrically shaped hollow support cylinder having an open outer end, said cylindrically shaped hollow support cylinder adapted to be supportably coextensive with an adhesive tape roll sleeve assembly mounted thereon, said hollow support cylinder being configured to provide rigid support to an adhesive tape roll assembly mounted thereon around its entire inner periphery at a point closely adjacent said open outer end of said hollow support cylinder said hollow support cylinder provided with a plurality of resiliently mounted radially extending adhesive tape roll sleeve-engaging flange elements provided along the outer peripheral edge of said open outer end of said hollow support cylinder, said hollow support cylinder having an integral elongate handle portion extending axially outwardly from one end thereof, said hollow support cylinder provided with an adhesive tape roll sleeve-engaging annular stop flange at the handle end of said hollow support cylinder, said annular stop flange being in axially aligned spaced-apart register with said sleeve-engaging flange elements, said annular stop flange and said sleeve-engaging flange elements cooperating to selectively slidably retain an adhesive tape roll sleeve assembly mounted therebetween against relative axial movement on said hollow support cylinder while permitting selective rotative movement of the adhesive tape roll sleeve assembly on said support cylinder.

2. In the lint remover assembly of claim 1 wherein an adhesive tape roll sleeve assembly is provided for selectively axially slidable covering engagement with said hollow support cylinder, said adhesive tape roll sleeve assembly being selectively rotatable on said hollow support cylinder.

3. In the lint remover assembly of claim 2 wherein said adhesive tape roll sleeve assembly includes a hollow sleeve member, said hollow sleeve member provided with a lint removing adhesive tape roll positioned thereon.

4. In the lint remover assembly of claim 1 wherein said handle portion comprises an elongate hollow conical handle member.

5. In the lint remover assembly of claim 1 wherein said handle portion comprises an elongate flat handle member.

6. In a lint remover assembly, the combination comprising:

a unitary integrally formed adhesive tape roll sleeve-engaging hollow support cylinder having an open outer end, said hollow support cylinder provided with a plurality of resiliently mounted radially extending adhesive tape roll sleeve-engaging flange elements provided along the outer peripheral edge of said open outer end of said hollow support cylinder, said hollow support cylinder having an integral elongate handle portion extending axially outwardly from one end thereof, said hollow support cylinder provided with an adhesive tape roll sleeve-engaging annular stop flange at the handle end of said hollow support cylinder, said annular stop flange being in axially aligned spaced-apart register with said sleeve-engaging flange elements, said annular stop flange and said sleeve-engaging flange elements cooperating to selectively slidably retain an adhesive tape roll sleeve assembly mounted therebetween against relative axial movement on said hollow support cylinder while permitting selective rotative movement of the adhesive tape roll sleeve assembly on said hollow support cylinder; and a closure plug provided for selective frictional engagement with said open outer end of said hollow support cylinder, said closure plug cooperating with said hollow support cylinder so as to define a storage compartment therein.

7. In a lint remover assembly, the combination comprising:

a unitary integrally formed adhesive tape roll sleeve-engaging hollow support cylinder having an open outer end, said hollow support cylinder having an integral elongate handle portion extending axially outwardly from one end thereof, said hollow support cylinder provided with a first adhesive tape roll sleeve-engaging annular stop flange at the handle end of said hollow support cylinder; and a closure plug provided for selective frictional engagement with said open outer end of said hollow support cylinder, said closure plug having a second adhesive tape roll sleeve-engaging annular stop flange in axially aligned spaced-apart register with said first adhesive tape roll sleeve-engaging annular stop flange when said closure plug is in closure engagement with said hollow support cylinder to define a storage compartment therein, said first adhesive tape roll sleeve-engaging annular stop flange and said second adhesive tape roll sleeve-engaging annular stop flange cooperating to selectively slidably retain an adhesive tape roll sleeve assembly mounted therebetween against relative axial movement on said hollow support cylinder while permitting selective rotative movement of the adhesive tape roll sleeve assembly on said hollow support cylinder.

8. In the lint remover assembly of claim 7 wherein an adhesive tape roll sleeve assembly is provided for selectively axially slidable covering engagement with said hollow support cylinder, said adhesive tape roll sleeve assembly being selectively rotatable on said hollow support cylinder.

9. In the lint remover assembly of claim 8 wherein said adhesive tape roll sleeve assembly includes a hollow sleeve member, said hollow sleeve member provided with a lint removing adhesive tape roll positioned thereon.

* * * * *